US008689410B2

(12) United States Patent
Arnold et al.

(10) Patent No.: US 8,689,410 B2
(45) Date of Patent: Apr. 8, 2014

(54) TONGUE

(75) Inventors: David R. Arnold, Macomb, MI (US); Michael J. Moore, Attica, MI (US); Bayard C. Temple, Washington, MI (US)

(73) Assignee: Key Safety Systems, Inc., Sterling Heights, MI (US)

( * ) Notice: Subject to any disclaimer, the term of this patent is extended or adjusted under 35 U.S.C. 154(b) by 329 days.

(21) Appl. No.: 12/973,996

(22) Filed: Dec. 21, 2010

(65) Prior Publication Data

US 2011/0154624 A1 Jun. 30, 2011

Related U.S. Application Data

(60) Provisional application No. 61/290,623, filed on Dec. 29, 2009.

(51) Int. Cl.
*A44B 11/25* (2006.01)

(52) U.S. Cl.
USPC ..... 24/633; 24/198

(58) Field of Classification Search
CPC ..... A44B 11/25
USPC ..... 24/198, 633; 280/733
See application file for complete search history.

(56) References Cited

U.S. PATENT DOCUMENTS

| | | | | |
|---|---|---|---|---|
| 3,929,348 | A * | 12/1975 | Lawwill | 280/733 |
| 6,019,388 | A | 2/2000 | Okazaki | |
| 6,109,647 | A | 8/2000 | Akaba et al. | |
| 6,471,243 | B1 | 10/2002 | Brown | |
| 6,591,465 | B2 | 7/2003 | Suyama | |
| 2004/0245761 | A1 * | 12/2004 | Maloney et al. | 280/801.1 |

FOREIGN PATENT DOCUMENTS

| | | | | |
|---|---|---|---|---|
| GB | 2260782 | A | 4/1993 | |
| JP | 01083436 | A * | 3/1989 | B60R 21/18 |
| WO | WO 2009155534 | A1 * | 12/2009 | B60R 21/18 |

* cited by examiner

*Primary Examiner* — Robert J Sandy
*Assistant Examiner* — David Upchurch
(74) *Attorney, Agent, or Firm* — Markell Seitzman

(57) ABSTRACT

A tongue (200, 400) for an inflatable belt restraint system, the tongue comprising: a narrow cylindrical hollow tube (204*a*, 204*b*) comprising a first formed member and a second formed member joined together along respective mating edges of the first and second formed members and two mating portions (202*a* and 202*b*) forming the looped portion of the tongue.

11 Claims, 5 Drawing Sheets

TONGUE

BACKGROUND AND SUMMARY OF THE INVENTION

This application claims the benefit of U.S. Provisional Application 61/290,623, filed on Dec. 29, 2009. The disclosure of the above application is incorporated herein by reference.

The present invention relates to seat belts in general and more particularly to an improved tongue for a seat belt system with an inflatable air bag.

DETAILED DESCRIPTION OF THE DRAWINGS

Figure 1:
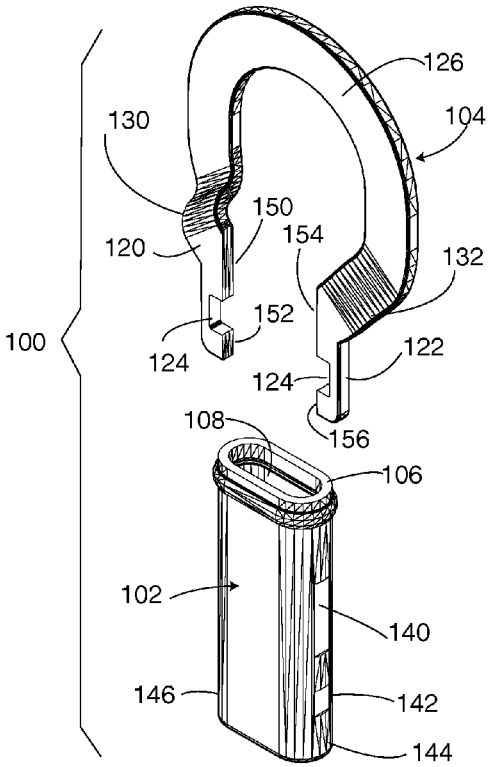
FIG. 1 shows a partially assembled tongue.
Figure 2:
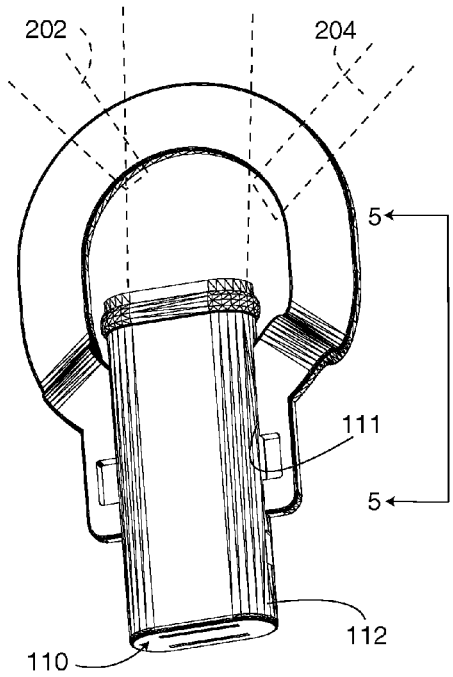
FIG. 2 shows an assembled tongue.
Figure 3:
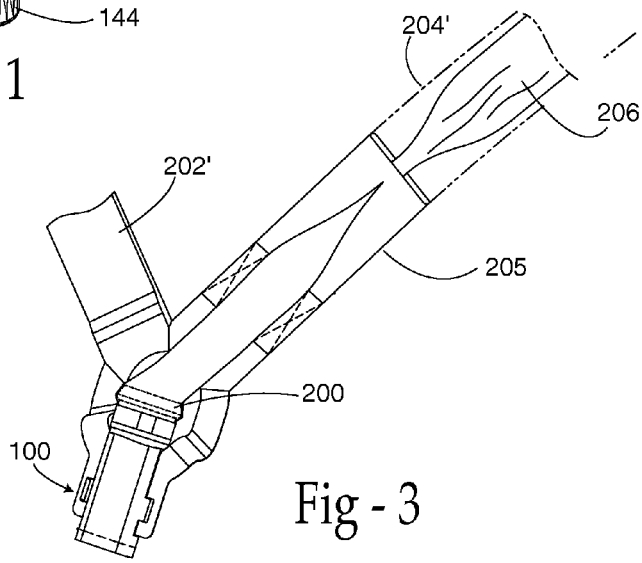
FIG. 3 is an enlargement showing the lap belt and shoulder belt (which includes the air bag) secured to a tongue.

FIGS. 1-5 show many of the elements from PCT patent application WP2009/155534A1 which is incorporated herein by reference. Reference is made to FIG. 1 which illustrates a tongue 100 useful with an inflatable belt restraint system. The tongue 100 comprises a hollow tubular body 102 and a ring or loop 104 connected thereto. Tubular body 102 includes an enlarged lip 106 to which an inlet tube 200 of an air bag is connected. Inflation gas is communicated from the inflator through the tongue to the air bag as shown in FIG. 3. The inlet tube can be separate from the air bag or an inlet or neck region thereof. Tubular body 102 further includes a central passage 108. The central passage is blocked by a frangible seal 110, shown in FIG. 2 inserted into the end of the passage 108. In FIG. 2, seal 110 is placed at the inlet end 112 of the tubular body. While not shown, the inlet end 112 is configured to be placed within a receptacle or buckle 236 (see FIG. 4). Inflation gas is transmitted from an inflator 240 through the buckle 238 and to the inlet end 112. The pressure of the inflation gas breaks the seal 110. Seal 110 may be placed anywhere within passage 108.

Loop 104 includes two legs 120 and 122; each of the legs includes a notch 124. Legs 120 and 122 are located in the same plane. Loop 104 includes an arched portion 126 which is located in a plane that is parallel to another plane that goes through legs 120 and 122. Transition portions 130 and 132 are bent to provide the transition between the legs 120, 122 and arched portion 126.

In FIG. 1 there are two phantom regions 140 and 142 located on one side 144 of the tubular body 102. Similar regions exist on the opposite side 146; only two such regions are visible. During the assembly of the loop 104 to the tubular body 102, regions 150 and 152 are aligned to the areas on side 144 while regions 154 and 156 are aligned to regions 140 and 142 on the opposite side 146. Subsequently, loop 104 is secured to the tubular body 102 such as by welding; the welds are shown by numeral 111 in FIG. 2.

One inflatable belt three-point seat belt system 201 includes a lap belt 202' and a shoulder belt 204', the lap and shoulder belt is connected to one or two seat belt retractors. In FIG. 3, one end of the lap belt 202' is looped about one side of the loop 126 of the tongue. One end of the shoulder belt 204' is looped about another side of the loop 126 of the tongue. The other ends of the lap and shoulder belts are respectively connected to a seat belt retractor 230 and 202 shown in FIG. 4. The inlet tube 200 is received within the shoulder belt which is fabricated as a hollow tube with the air bag 206 located therein. With inflatable belt systems, the shoulder belt will often include a hollow tubular portion within which the air bag 206 is stored. One end of the tube is wrapped or looped over the loop of the tongue while the opposite end of the tube is connected to a conventional woven seat belt; the seat belt is received about the spool of retractor 230.

Figure 4:
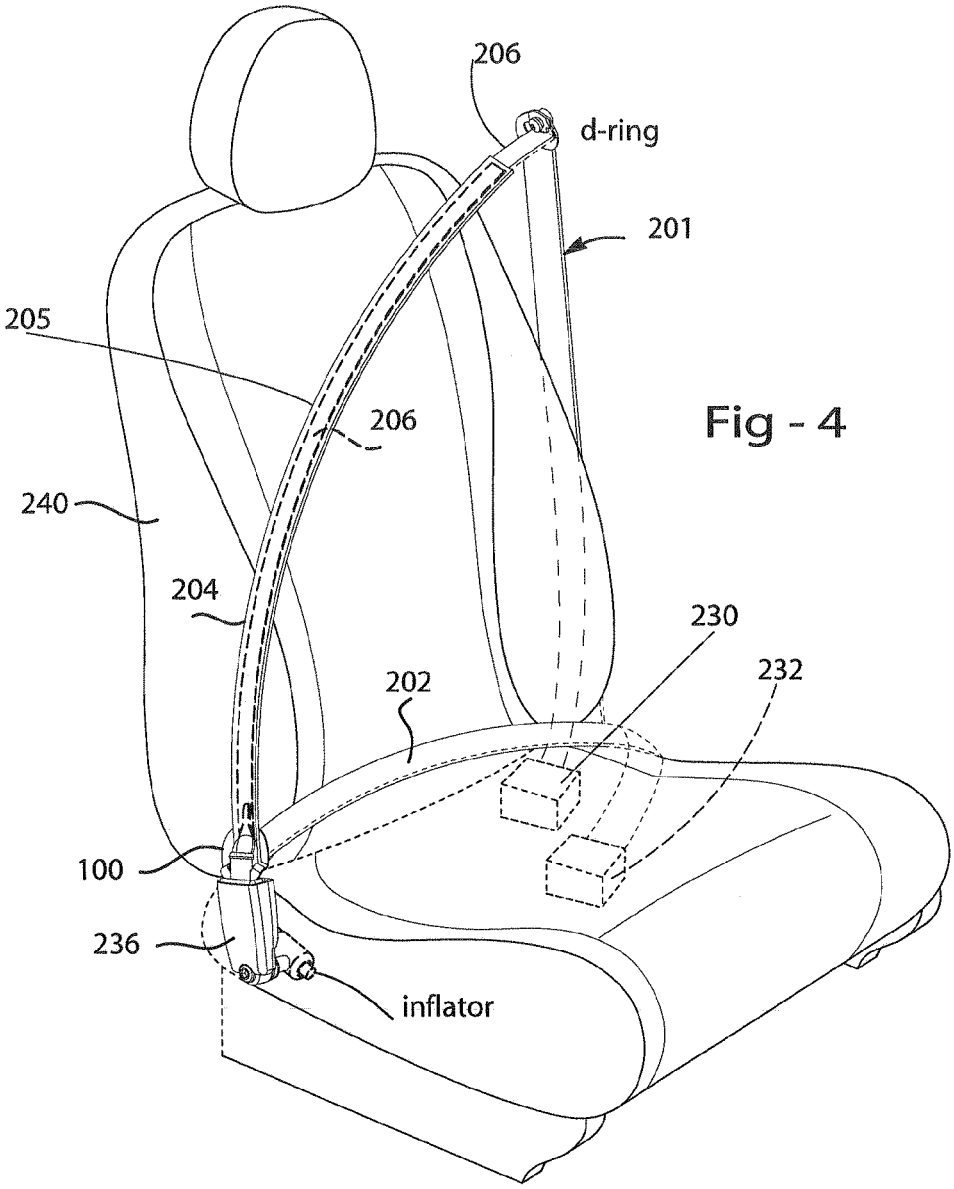
FIG. 4 shows a seat belt system installed about a seat.
Figure 5:
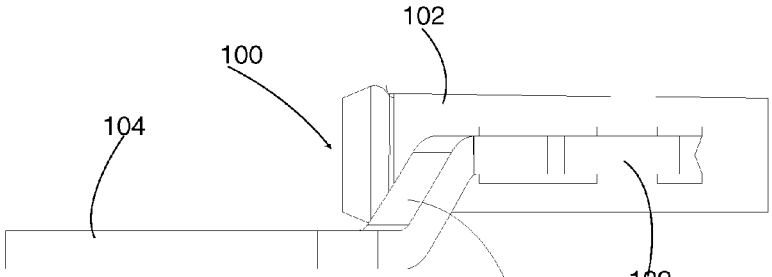
FIG. 5 is a side view of the tongue of FIG. 2.

FIG. 4 shows the above belt system 201 located about a vehicle seat 240. FIG. 5 is a side view of tongue 100.

Figure 6:
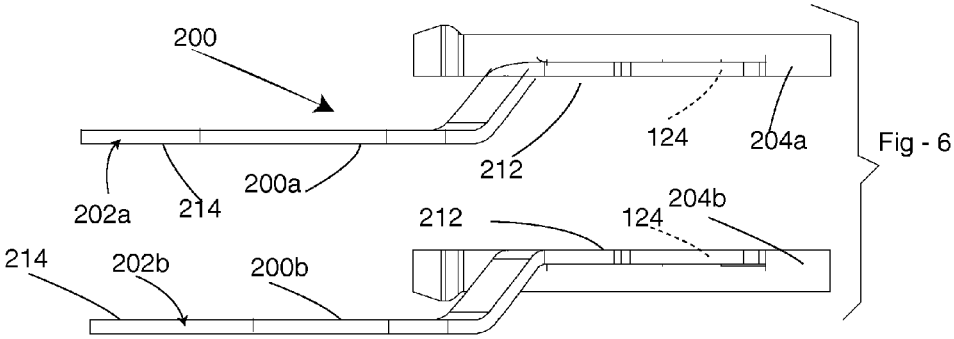
FIG. 6 is a side view of a split tongue.
Figure 7:
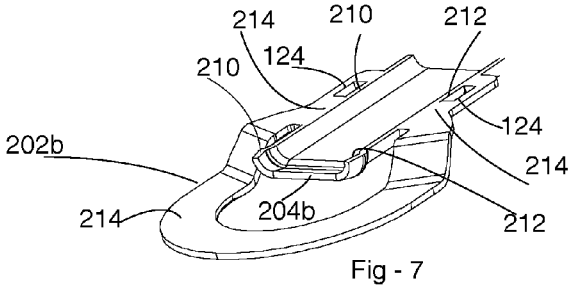
FIG. 7 is an isometric view of the halves of the split tongue.

The system includes a buckle which is described in greater detail in the above referenced document; the buckle includes a latch which is received within openings 124. During an accident with the tongue locked in the buckle, some forces transmitted to the tongue pass through the common regions 140 and 142, which is also the location of the weld joints. The area of the weld joints is relatively small causing the forces at the weld joint to rise. An improved tongue 600 shown in FIG. 6 has greater common regions which reduce the forces per unit area that have to be absorbed at the common areas. Reference is again made to FIG. 5. If the tongue 100 were sliced down the center of tube 102 and if the loop 102 including portions 122, 132 and 126 were also sliced in half, the result would be the segmented tongue 200 shown in FIG. 6 with a first and second tongue portions 200*a* and 200*b*. Each portion can be about one-half of the tongue. Each tongue portion 200*a* and 200*b* could be a metal stamping or formed polymer. As can be appreciated, in this embodiment, the loop is no longer welded to the tube as described above (or tube portion in this case). Each tongue portion 200*a* and 200*b* includes a thin loop portion 202*a* and 202*b* and half of a tube 204*a* and 204*b*. Portions 202*a* and 204*a* and 202*b* and 204*b* are respectively of integral construction. Portions 204*a* and 204*b* are also referred to as a tube-half. Portions 202*a* and 202*b* are also referred to as a loop-half. The spaces 124 on each of a tongue portion 200*a* and 200*b* are fabricated during the stamping process, the spaces 124 are also shown in FIG. 7. FIG. 7 also shows the edges 210 and 212 for tube-half 204*a* created by the stamping process. The inner surface 214 of the loop-half 202*a* is also visible in FIG. 7. The other half 202*b* of the tongue will also include the spaces 124, edges 210 and 212 and inner surface 214.

Figure 8:
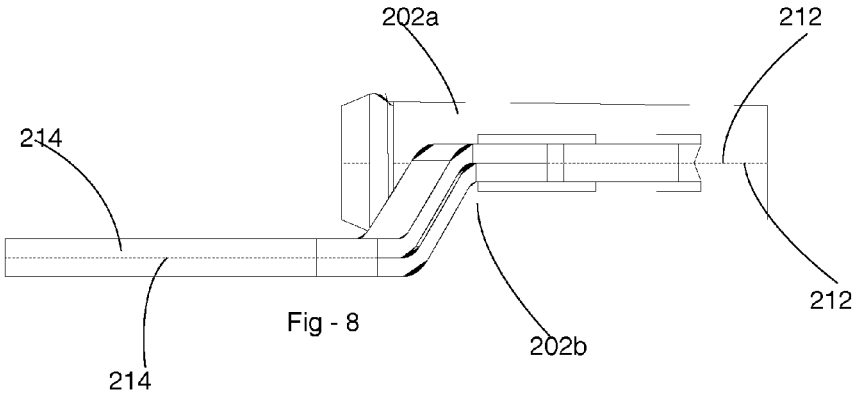
FIG. 8 is a side view of the split tongue.
Figure 9:
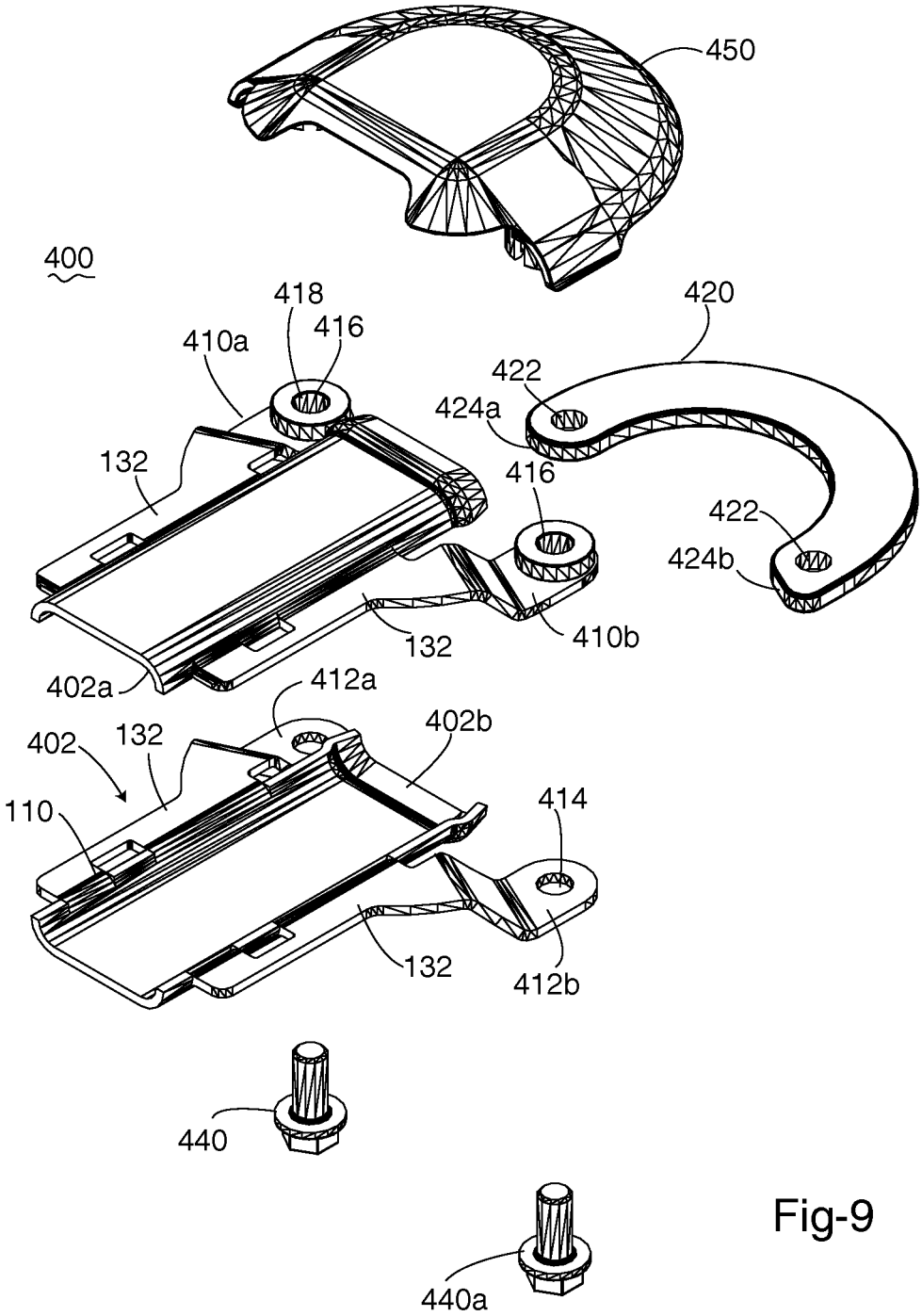
FIGS. 9-11 show another tongue.

Reference is made to FIG. 8 which shows the two halves 202*a* and 202*b* mated together. The mating edges 210 and 212 of each tube-half 204*a* and 204*b* can be welded or braised along the entire mating edges. The two loop halves 202*a* and 202*b* can be welded or braised along the entirety of the mating surfaces 214. Alternately, the mating surfaces 214 can be spot welded at appropriate points. As can be appreciated, tongue 300 includes more common areas making for a more robust buckle.

As known in the art, conventional 3-point seat belt systems are supplied from the component manufacturer to the vehicle maker as an assembly comprising the tongue, d-ring, seat belt, retractor or retractors. In a two-retractor system, the lap belt retractor is often mounted proximate the seat for example by a pillar of the vehicle (such as the B-pillar, C-pillar, D-pillar). If the design of the vehicle has the lap belt retractor hidden by trim proximate the side of the vehicle and if all of the above parts are shipped as an assembly, the trim will have to have an opening large enough so that the lap belt retractor can be passed through the trim opening and subsequently mounted to the vehicle. Having a large opening in the trim is problematic to a vehicle interior designer as debris can easily fall through the very large opening and the large opening detracts from the aesthetics of the vehicle interior. In this embodiment, it is envisioned, the shoulder belt, shoulder belt retractor, d-ring and an alternate tongue 400 will be shipped as a first subassembly. In this embodiment, the tongue includes a tubular portion and a looped portion (also referred to as a primary loop) that is articulated relative to the tubular portion. The articulated looped portion is fixed in place during normal operation. The fixation (a fastener) can be removed permitting the loop to articulate about a hinge which permits the shoulder belt or lap belt to be slipped upon a free end of the loop. The articulated loop is later locked in place. In this embodiment it is not necessary for the lap belt and lap retractor to be part of the same assembly as the shoulder belt retractor but this can be done in the present invention too. The articulated loop permits the tongue end of the lap belt to be pulled through a narrow slit in the trim and later secured to the tongue loop most probably even after installation of the lap retractor. In a further embodiment of the invention the tongue includes the primary loop which can be fixed or articulated and a secondary member 480. The shoulder belt is secured to the primary loop 420. The lap belt can be looped or threaded through the secondary member 480 which can be located on the primary loop 420 or about other portions of the tongue.

The lap belt includes a retractor end connected to the retractor and a tongue end connected to the tongue 400. The tongue end of the lap belt is formed into a loop into which a portion of the articulated loop 420 of tongue 400, of FIGS. 9-12, is later inserted. Tongue 400 includes a tube 402 which may be of a one-piece construction or fabricated of two halves 402*a* and 402*b*. The tube 402 can also include the seal 110 shown above. The seal 110 is diagrammatically shown as can be fitted upon one of the tube halves. Each tube half includes structure analogous to belt lower portions 132 of the loop 214 which terminate in a flattened region. Tube half 402*a* includes flattened regions 410*a* and 410*b*, each with a respective hollow cylindrical projection 416*a* or 416*b*.

Each hollow cylindrical projection includes a center bore 418. The flat portions 412*a* and 412*b* of tube half 402*b* each include an opening 414. A fastener such as a pin, bolt or rivet 440 is configured to enter the opening 414 and extend through the bores 418. The fasteners 440 secure the loop segment 420 to the tube 402. The loop segment 420 includes openings 422 at respective ends thereof. After the tube halves 402*a* and 402*b* are welded together, facing flat portions 410*a* and 412*a* and 410*b* and 412*b* are spaced apart a sufficient distance to permit entry of an end 424*a*, 424*b* of the loop 420. For example, end 424*b* is inserted between the flat portions 410*b* and 412*b* with a fastener 440*a* extending through openings 414, 416, 422. Fastener 440*a* is configured as a hinge about which the loop 410 can rotate. Once the retractors are mounted within the vehicle, the loop is inserted into the looped end of the shoulder belt. The inlet tube 200 is connected to the tube. The looped end of the lap belt is also placed about the free end of the tongue loop 420. Thereafter, fastener 440 secures end 424*a* to the tube. Fastener 440 can be configured as a rivet or bolt. The tongue 400 also includes a cover.

Figure 10:
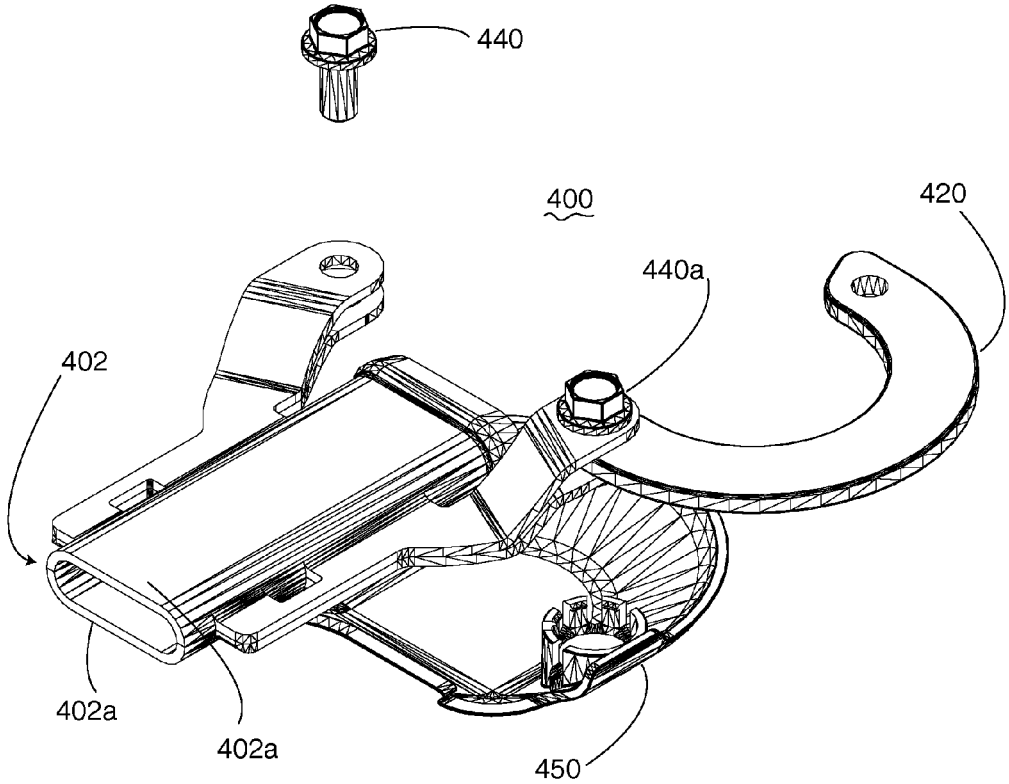
Figure 11:
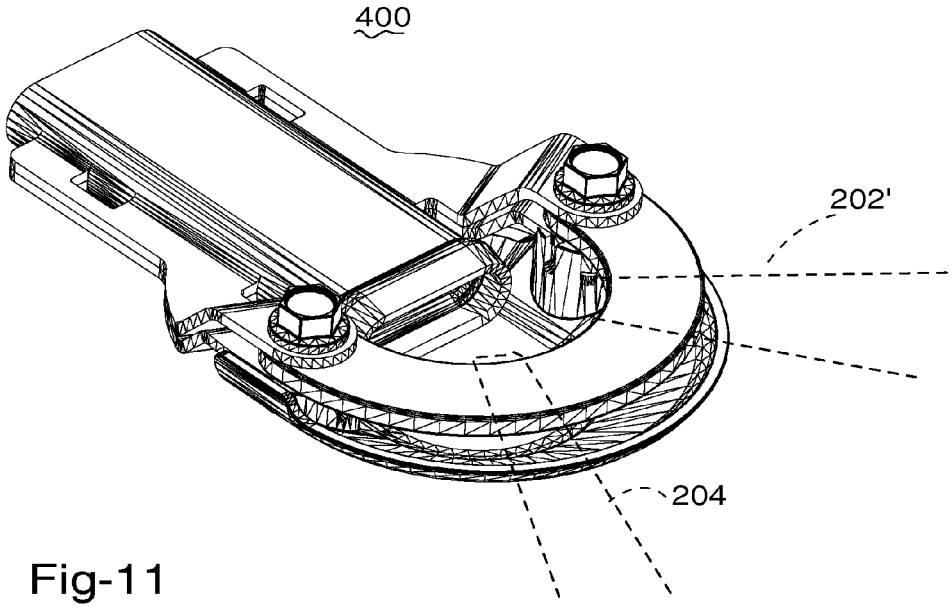

FIG. 10 shows the tube halves 402*a*, 402*b* connected together with the loop 420 pivotably connected to the bent-over flat portions 132, 410*a*, 410*b*, 412*a* and 412*b*. FIG. 11 diagrammatically shows the shoulder belt 204' and lap belt 202' ends secured to the loop 420.

Figure 12:
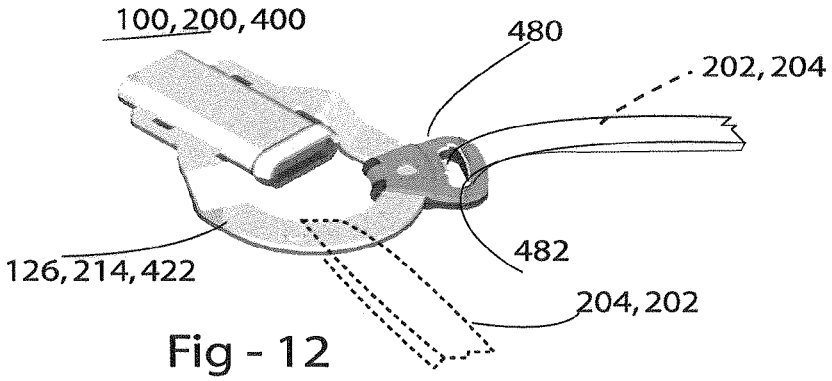
FIG. 12 shows an alternate embodiment of the invention.

Reference is briefly made to FIG. 12 which shows an alternate embodiment of the invention. In this embodiment, an additional or secondary loop 480 is secured to any of the above described loops 126, 214 and/or 422. Loop 480 includes an opening 480 to receive one of the lap belt and shoulder belt. The second loop would be installed upon the fixed loops such as 126 or 214. The second loop could be slipped upon the free end of loop 422.

Many changes and modifications in the above-described embodiment of the invention can, of course, be carried out without departing from the scope thereof. Accordingly, that scope is intended to be limited only by the scope of the appended claims.

The invention claimed is:

1. A tongue for an inflatable belt restraint system, the tongue comprising:

a loop to receive a portion of the belt, wherein the loop is formed of a mating first loop part and a second mating loop part, each loop part extending from a respective portion of one of the first or second formed members; wherein the first loop part is integrally formed with the first formed member and the second loop part is formed as an integral part of the second formed member;

wherein each of the first loop part has a first projection with a first projection facing surface and a second projection with a second projection facing surface and wherein and the second loop part has a third projection with a third projection facing surface and a fourth projection with a fourth projection facing surface, wherein the first and third projection facing surfaces are spaced from one another and face each other and the second and fourth projection facing surfaces are spaced from one another and face each other; and wherein the tongue includes a connecting member which extends between the first and third projection facing surfaces and the second the forth projection facing surfaces.

2. The tongue according to claim 1 wherein the first and third projections are configured as part of a hinge and wherein the connecting member is rotatable therebetween.

3. The tongue according to claim 2 wherein the second and fourth projections are configured to receive an end portion of the connecting member which is opposite the hinge and wherein the end portion of the connecting member is fixedly connected to the second and fourth projections.

4. The tongue according to claim 1 wherein each of the first and second formed member is one of a metal stamping or a polymer, each of the first and second formed member having a back and narrow upraised sides, each side having one of the mating edges.

5. The tongue according to claim 4 wherein the mating edges are joined together by one of braising or welding.

6. The tongue according to claim 1 wherein each of the first loop part and the second loop part have facing surfaces and wherein each facing surface is configured to mate with each other and wherein the first and second loop parts are joined together along an adjacent edge.

7. A tongue for an inflatable belt restraint system, the tongue comprising:

a loop to receive a portion of the belt, the loop formed of two mating parts, wherein the loop is formed of a mating first loop part and a second mating loop part, each loop part extending from a respective portion of one of the first or second formed members;

wherein the mating first loop part is formed integrally with the first formed member and extends away from each of the upraised sides, wherein a first latch opening is located in the first formed member proximate one of an upraised side and a second latch opening proximate an opposite upraised side, and wherein the mating second loop part is formed integrally with the second formed member and extends away from each of the upraised sides of the second formed member, wherein a third latch opening is located in the second formed member proximate one of an upraised side and a fourth latch opening proximate an opposite upraised side; and, wherein when the first and second formed members are aligned one to the other, each of the first and third and second and fourth latch openings are also aligned.

8. A tongue for an inflatable belt restraint system, the tongue comprising:

a narrow cylindrical hollow tube comprising a first formed member and a second formed member joined together along respective mating edges of the first and second formed members and including a loop to receive a portion of the belt, the loop formed of two mating parts; wherein the loop is articulated and movable from a locked position to an articulated portion.

9. The tongue according to claim 8 including a secondary member to receive a belt portion.

10. The tongue according to claim 9 wherein the secondary member is attached to the loop.

11. The tongue according to claim 10 wherein the secondary member is another loop.

* * * * *